US007607743B2

(12) United States Patent
Jang

(10) Patent No.: US 7,607,743 B2
(45) Date of Patent: Oct. 27, 2009

(54) HOME-BAR DOOR STOPPING STRUCTURE FOR REFRIGERATOR

(75) Inventor: Chan-Kyoo Jang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/275,318

(22) Filed: Dec. 22, 2005

(65) Prior Publication Data

US 2006/0138920 A1 Jun. 29, 2006

(30) Foreign Application Priority Data

Dec. 28, 2004 (KR) ..... 10-2004-0114456

(51) Int. Cl.
*A47B 96/00* (2006.01)

(52) U.S. Cl. ..... 312/405; 312/404; 62/265

(58) Field of Classification Search ..... 312/401, 312/402, 404, 405, 405.1, 406, 406.1, 406.2, 312/407.1, 291–292, 407; 49/501; 62/441, 62/447, 265

See application file for complete search history.

(56) References Cited

U.S. PATENT DOCUMENTS 4,087,143 A * 5/1978 Barnard et al. ..... 312/405
4,306,757 A * 12/1981 Horvay et al. ..... 312/292
5,209,082 A * 5/1993 Ha ..... 62/265
6,055,823 A * 5/2000 Baker et al. ..... 62/265
7,059,693 B2 * 6/2006 Park ..... 312/405.1
7,108,342 B2 * 9/2006 Shin et al. ..... 312/405
2003/0103023 A1 * 6/2003 Ootsuka et al. ..... 345/87
2003/0132690 A1 * 7/2003 Shin et al. ..... 312/405
2004/0178710 A1 * 9/2004 Kim et al. ..... 312/405

FOREIGN PATENT DOCUMENTS

DE 4233135 * 4/1994 ..... 62/265
KR 2004-0046467 6/2004

* cited by examiner

*Primary Examiner*—Hanh V Tran
(74) *Attorney, Agent, or Firm*—Fish & Richardson P.C.

(57) ABSTRACT

A home-bar door stopping structure of a refrigerator includes an accommodating space provided behind a refrigerator door and communicating with the outside of the refrigerator through an opening formed on a portion of the refrigerator door, a home-bar door installed to the opening for selectively opening and closing the accommodating space and configured to be pivoted vertically about an lower end of the opening, and stoppers provided on both sides of the opening for supporting both sides of a lower end of a rear surface of the home-bar door to limit a pivot range of the home-bar door when the opening is opened. When the home-bar door stopping structure is so configured, although the thickness of the home-bar door is relatively increased due to the installation of an additional device onto the front surface of the home-bar door, the stopper does not hinders the pivotal rotation of the home-bar door until the home-bar is pivoted up to the predetermined angle.

12 Claims, 4 Drawing Sheets

HOME-BAR DOOR STOPPING STRUCTURE FOR REFRIGERATOR

BACKGROUND OF THE INVENTION

1. Field of Invention

The present invention relates to a refrigerator, and more particularly, to a home-bar door stopping structure for a refrigerator which limits the rotation of a home-bar door for selectively opening or closing a home-bar installed on the refrigerator.

2. Description of the Prior Art

As the refrigerator becomes larger, a dispenser and a home-bar have been recently installed on a side-by-side refrigerator. The home-bar is a device for gaining access to beverages stored in a refrigerating chamber from the outside without opening a refrigerating chamber door of the refrigerator. The home-bar can be selectively opened or closed by a home-bar door.

FIG. 1 shows the front external appearance of a conventional side-by-side refrigerator, and FIG. 2 shows a side sectional view of a home-bar stopping structure according to the related art.

As described in the figures, a storage space is defined within a main body 11 of a side-by-side refrigerator (hereinafter, referred to as "refrigerator"). The storage space is divided into right and left sections which in turn are formed into freezing and refrigerating chambers, respectively. The freezing and refrigerating chambers are selectively opened or closed by freezing and refrigerating chamber doors 13 and 15, respectively. The freezing and refrigerating chamber doors 13 and 15 are hinged to both sides of a front surface of the main body 11, respectively.

A dispenser 17 for taking water and ice from the outside is provided on the front surface of the freezing chamber door 13. The dispenser 17 is installed in the main body 11 and connected to an ice maker (not shown) for storing ice therein and a water tank (not shown) for storing water therein.

An opening 19 for communicating the refrigerating chamber with the outside is formed at a position on the front surface of the refrigerating chamber door 15. A desired accommodating space 21 is also provided behind the refrigerating chamber door 15 at a location corresponding to the opening 19. Beverages and the like are stored in the accommodating space 21.

The opening 19 is selectively opened or closed by a home-bar door 23. The home-bar door 23 is formed to have a shape corresponding to the opening 19. Both sides of a lower end of the home-bar door 23 are connected to both ends of a lower end of the opening 19, respectively, through hinges H1. Accordingly, the home-bar door 23 can be pivoted on the lower end thereof in a vertical direction.

A front external appearance of the home-bar door 23 is defined by a door panel 24 which is made of the same material as a door panel of the door 15. A rear external appearance of the home-bar door 23 is defined by a door liner 25. An insulation layer 26 is also provided in a space defined between the door panel 24 and the door liner 25.

In the meantime, a stopper 19*s* is provided on the lower end of the opening 19. The stopper 19*s* prevents the home-bar door 23 from being pivoting at an angle greater than a predetermined angle, when the accommodating space 21 has been opened.

The stopper 19*s* is provided at a position spaced apart upward from the lower end of the opening 19 by a predetermined height corresponding to a thickness of the home-bar door 23. The stopper 19*s* is formed lengthwise along a right and left direction and protrudes forward by a predetermined length. Accordingly, when the home-bar door 23 shields the accommodating space 21, the home-bar door 23 can be pivoted until the lower end of the door liner 25 is brought into close contact with and supported by a lower surface of the stopper 19*s*.

Further, a pivoting space S1 is provided in the refrigerating chamber door 15 at a position corresponding to a lower portion of the home-bar door 23. The pivoting space S1 serves to prevent the lower end of the home-bar door 23 from interfering with the lower end of the opening 19 when the home-bar door 23 is pivoted.

A handle 27 is also provided at a certain position on a front surface of the home-bar door 23. The handle 27 is a portion which is gripped by a user when the user intends to open the home-bar door 23. Further, a locking device (not shown) is provided to prevent the home-bar door 23 from being inadvertently rotated when the accommodating space 21 is closed by the home-bar door 23.

However, the related art home-bar door stopping structure so configured has the following problem.

That is, the stopper 19*s* for limiting the pivot range of the home-bar door 23 has been formed lengthwise on the lower end of the opening 19 in a right and left direction. Thus, if the thickness of the home-bar door 23 is relatively thicker due to the installation of additional devices, e.g. an LCD unit, a tablet computer and a television set, the stopper 19*s* hinders the pivoting motion of the home-bar door 23. Accordingly, when the thickness of the home-bar door 23 is increased, there is a problem in that the conventional stopper 19*s* cannot be applied thereto.

SUMMARY OF THE INVENTION

The present invention is conceived to solve the aforementioned problem in the prior art. Accordingly, an object of the present invention is to provide a home-bar door stopping structure for a refrigerator which can be applied to the refrigerator regardless of the size and shape of the home-bar door.

According to an aspect of the present invention for achieving the object, there is provided a home-bar door stopping structure for a refrigerator which comprises an accommodating space provided behind a refrigerator door and communicating with the outside of the refrigerator through an opening formed on a portion of the refrigerator door, a home-bar door installed to the opening for selectively opening and closing the accommodating space and configured to be pivoted vertically about an lower end of the opening, and stoppers provided on both sides of the opening for supporting both sides of a lower end of a rear surface of the home-bar door to limit a pivot range of the home-bar door when the opening is opened.

Preferably, the stoppers are provided on lower ends of stepped portions extending vertically along both sides of the opening.

A seating space for installing an additional device therein may be provided on a front surface of the home-bar door, and a protrusion protruding rearward by at least a height corresponding to a depth of the seating space may also be provided on the rear surface of the home-bar door.

Preferably, both side ends of the protrusion are set back from both side ends of the home-bar door by at least a distance corresponding to at a width of the stepped portion.

According to the home-bar door stopping structure for a refrigerator according to the present invention, there is an advantage in that the stoppers are provided on both sides of the opening to support both sides of a lower rear end of the home-bar door such that the stoppers can be applied regardless of the thickness of the home-bar door.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a home-bar door stopping structure for a refrigerator according to the present invention will be described in detail with reference to the accompanying drawings.

Figure 1:
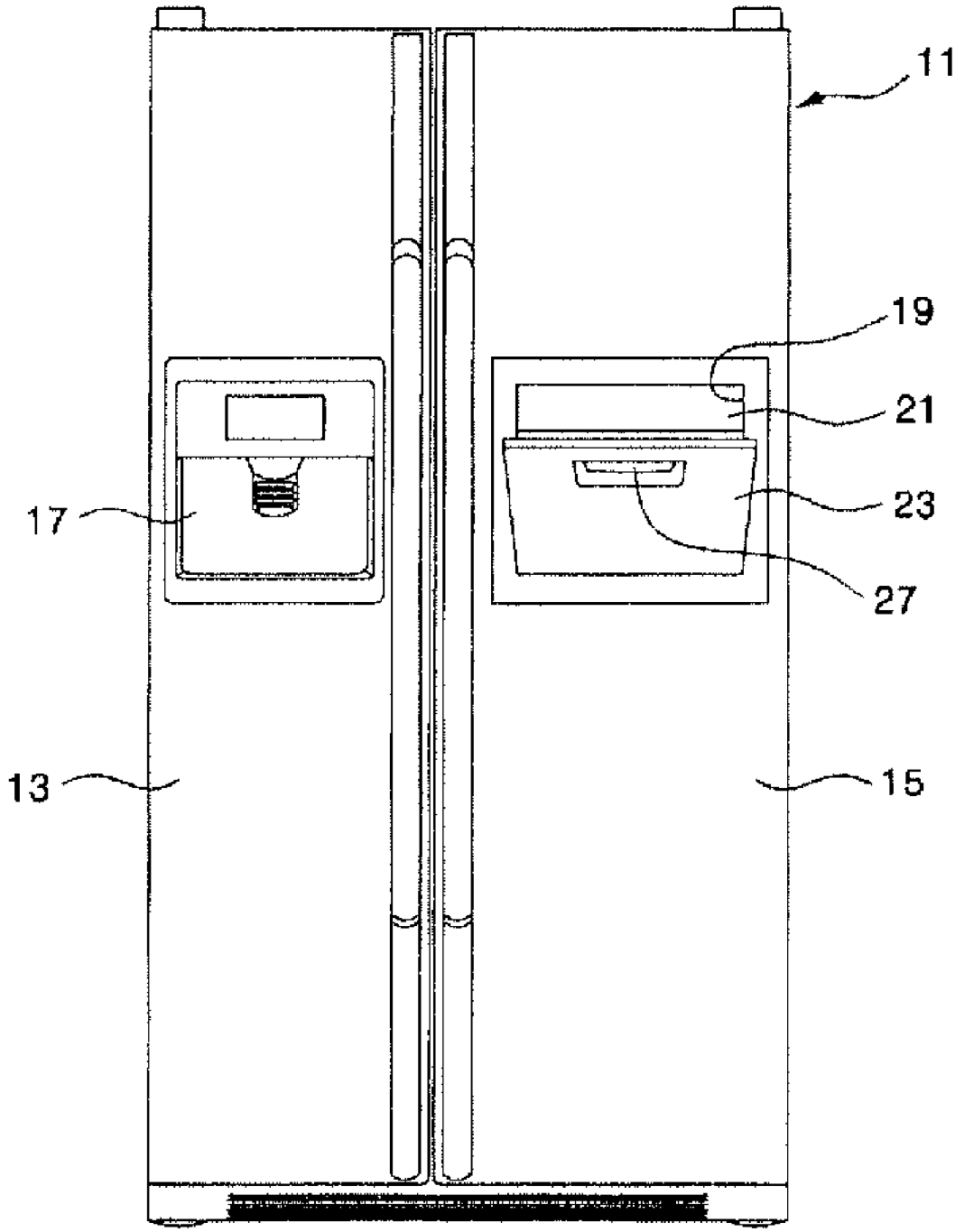
FIG. 1 (PRIOR ART)
FIG. 1 is a front view showing the front exterior appearance of a conventional side-by-side refrigerator.
Figure 2:
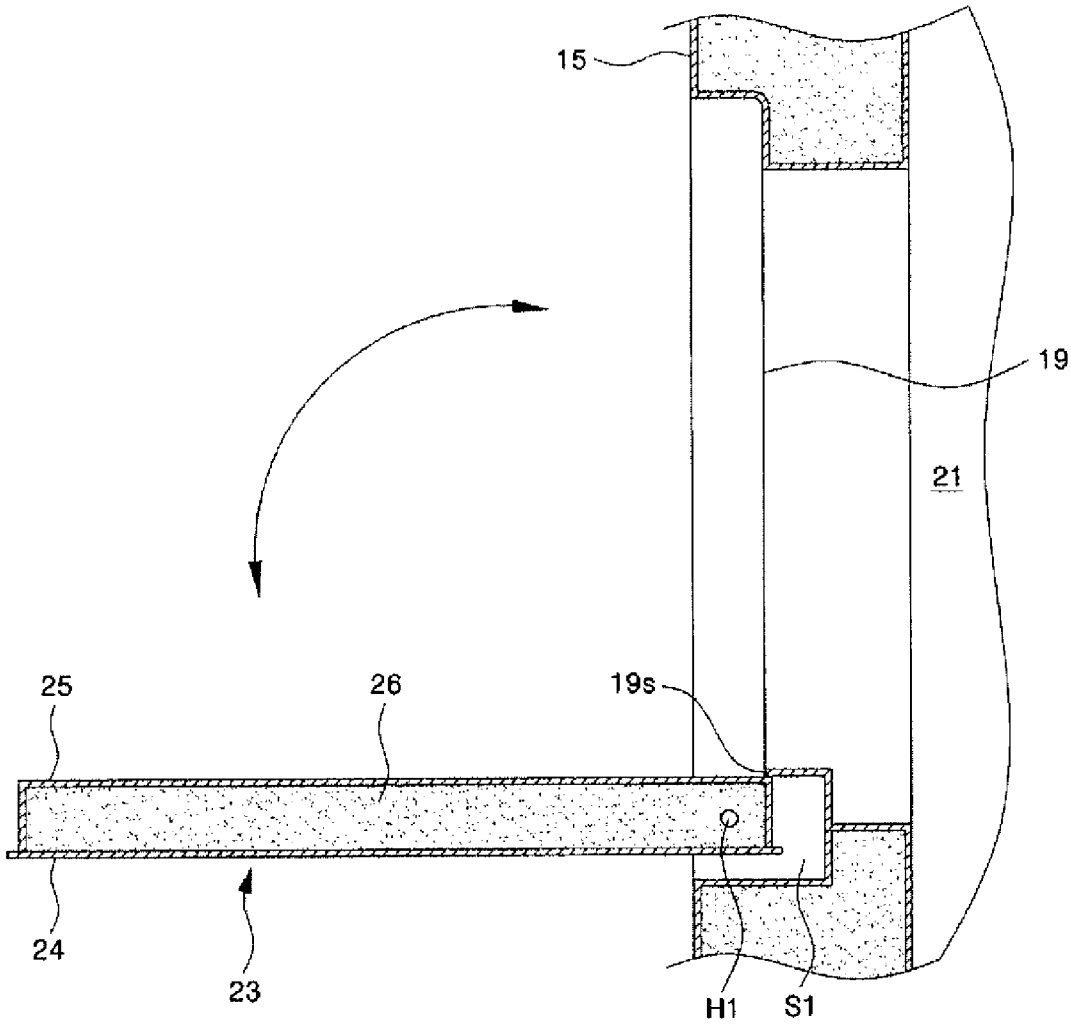
FIG. 2 (PRIOR ART)
FIG. 2 is a side sectional view showing a home-bar stopping structure according to a related art.
Figure 3:
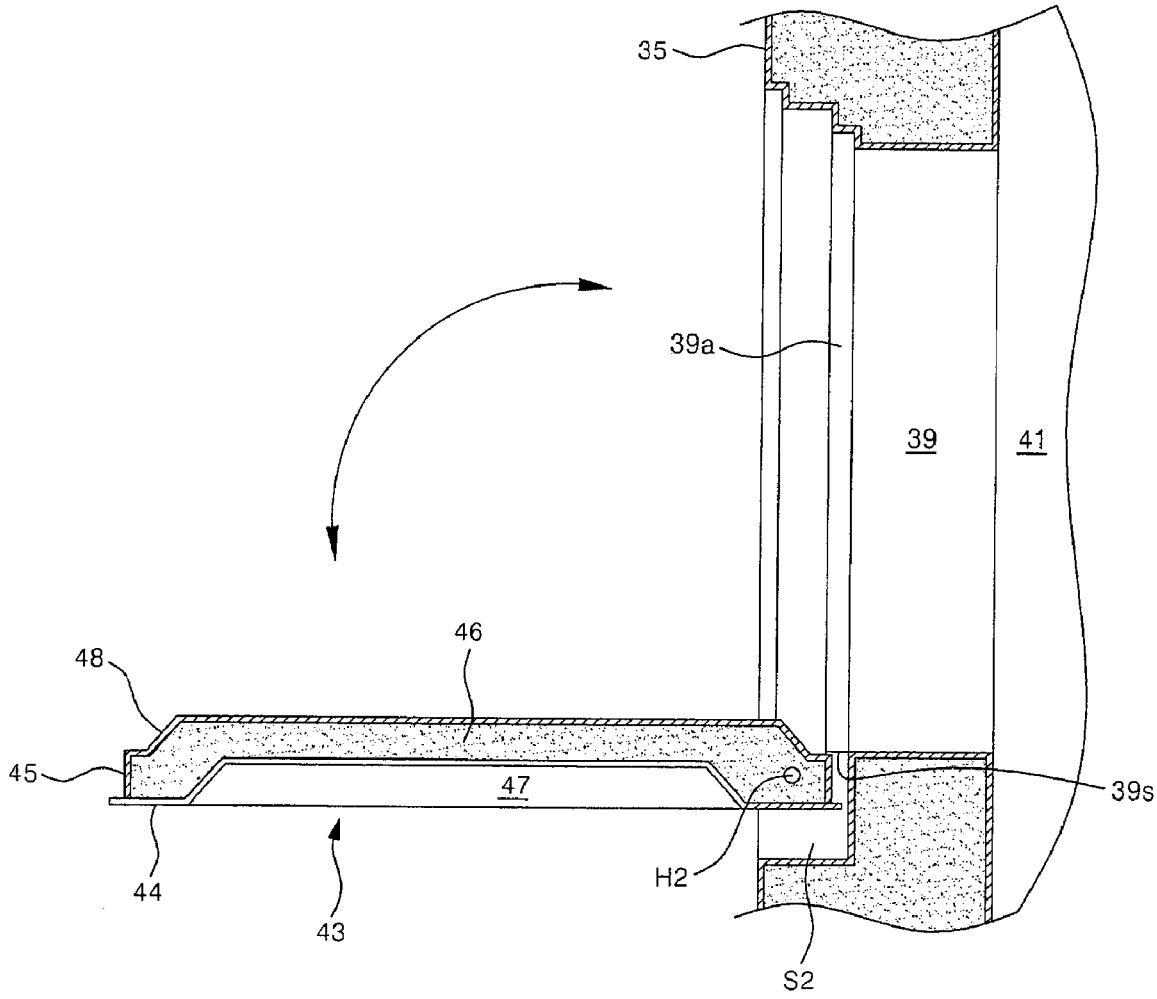
FIG. 3 is a side sectional view showing a preferred embodiment of a home-bar door stopping structure for a refrigerator according to the present invention.
Figure 4:
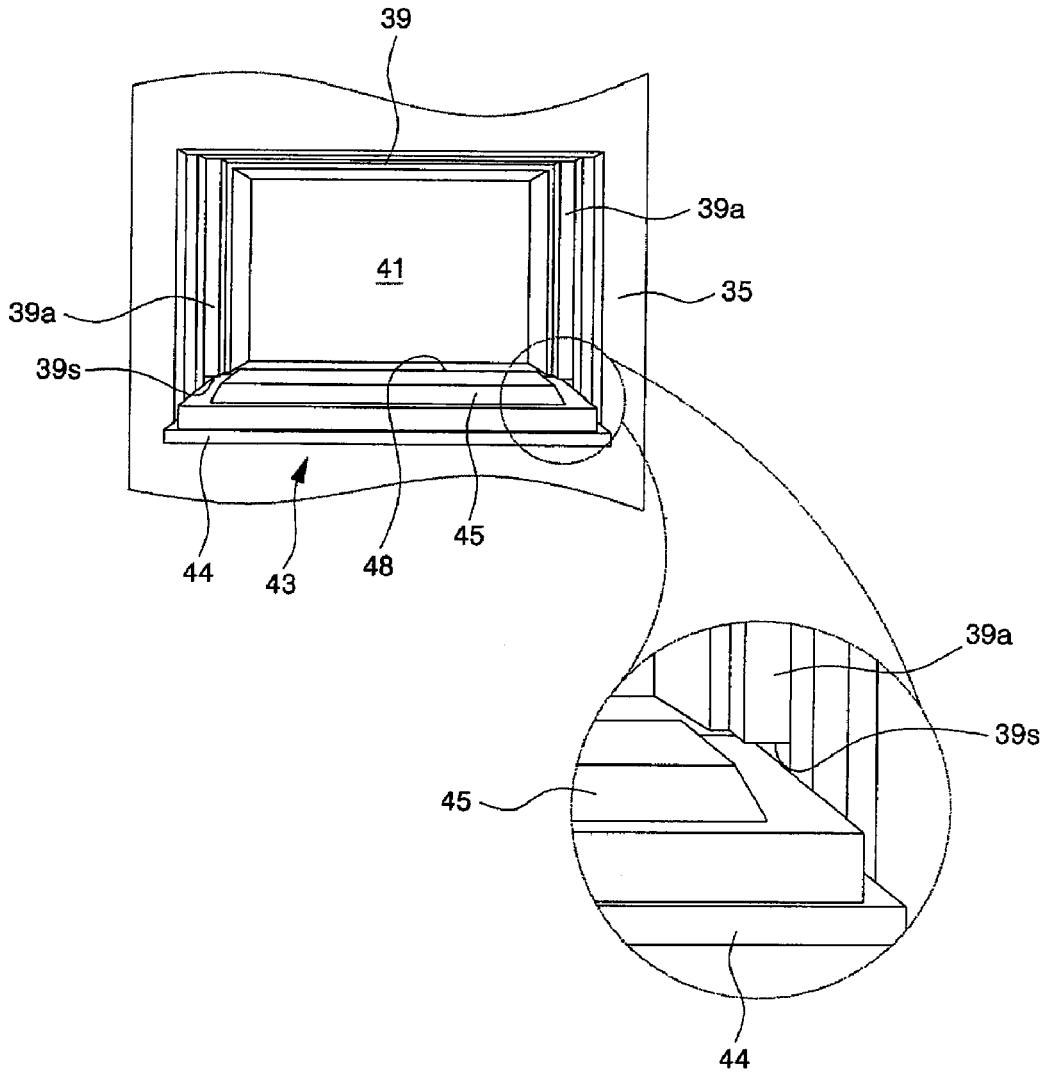
FIG. 4 is a front view showing the embodiment shown in FIG. 3.

FIG. 3 is a side sectional view showing a preferred embodiment of a home-bar door stopping structure for a refrigerator according to the present invention, and FIG. 4 is a sectional view of a preferred embodiment of the home-bar door stopping structure for a refrigerator according to the present invention.

As described in the figures, a refrigerator door 35 is provided with a home-bar. The home-bar serves to allow a user to put beverages and the like into or out of the refrigerator without opening the refrigerator door 35. The home-bar comprises a predetermined accommodating space 41 behind the refrigerator door 35 and a home-bar door 43 for selectively opening or closing the accommodating space 41.

Beverages and the like are stored in the accommodating space 41. The accommodating space 41 communicates with the outside through an opening 39 formed in the refrigerator door 35. Stepped portions 39*a* are formed on both right and left sides of the opening 39, respectively. The stepped portions 39*a* are formed lengthwise in a vertical direction and stepped at both sides of the opening 39 to have a predetermined width in a direction in which they face each other.

The home-bar door 43 is formed to have a size and shape corresponding to the opening 39. Both sides of a lower end of the home-bar door 43 are connected to both sides of a lower end of the opening 39, respectively, through hinges H2. Thus, the home-bar door 43 can be pivoted around the lower end thereof in a vertical direction such that the home-bar door 43 can selectively close or open the accommodating space 41.

A front external appearance of the home-bar door 43 is defined by a door panel 44. The door panel 44 is preferably made of the same material as the refrigerator door 35. A rear external appearance of the home-bar door 43 is defined by a door liner 45 formed on a rear surface of the door panel 44. An insulation layer 46 is also provided in a space defined between the door panel 44 and the door liner 45. The insulation layer 46 serves to block the heat exchange between the inside and outside of the accommodating space 41 and is formed to have a predetermined thickness.

Furthermore, a seating space 47 is provided on a front surface of the home-bar door 43. Additional devices such as a liquid crystal display (LCD) unit are installed on the seating space 47. However, since the insulation layer 46 should have a predetermined thickness enough to ensure desired insulation performance, a protrusion 48 protruding rearward by a height corresponding to a depth of the seating space 47 is formed on a rear surface of the home-bar 43.

In addition, both ends of the protrusion 48 are set back from both ends of the home-bar door 43 by a distance corresponding to a right to left width of the stepped portions 39*a*. Therefore, the protrusion 48 does not interfere with the stepped portions 39*a* while the home-bar door 43 is pivoted.

A stopper 39*s* is provided on the lower end of each stepped portion 39*a*. The stopper 39*s* serves to limit the pivot range of the home-bar door 43. The stopper 39*s* supports each of both sides of the lower end of the rear surface of the home-bar door 45 when the accommodating space 41 is opened by means of the pivot motion of the home-bar door 43. Therefore, the home-bar door 43 can be prevented from being further pivoted at an angle greater than a predetermined angle when the accommodating space 41 has been opened. That is, the lower end of each stepped portion 39*a* substantially functions as the stopper 39*s*.

Reference numerical S2, which has not yet explained, designates a pivoting space provided in the refrigerator door 35 for allowing the home-bar door to be rotated therein.

Although it is not shown, a handle which a user grips to pivot the home-bar door 43 may be provided. Further, a locking device may be provided to maintain a state where the accommodating space 41 is closed and shielded by the home-bar door 43.

Hereinafter, the operation of the preferred embodiment of the home-bar door stopper structure for a refrigerator according to the present invention so configured will be explained.

As described above, the protrusion 48 is formed by means of the seating space 47 in which an additional device such as the LCD unit is installed. The protrusion 48 is formed such that it can be prevented from interfering with the stepped portions 39*a* when the home-bar door 43 is pivoted. Therefore, although an additional device such as the LCD unit is installed to the home-bar door 43, the home-bar door 43 does not interfere with the protrusion 48 while the home-bar door is pivoted.

Next, it will be explained how the accommodating space 41 is opened or closed by the home-bar door 43. First, in a state where the accommodating space 41 is covered by the home-bar door 43, the front surface of the home-bar door 43 is positioned at the same plane of the front surface of the refrigerator door 35. At this time, an edge of the door liner 45 is brought into close contact with an edge of the opening 39.

In such a case, a user grips the handle and causes the home-bar door 43 to be pivoted on the lower end thereof in a counterclockwise direction as viewed from the figure. Therefore, the accommodating space 41 is opened. If the accommodating space 41 is opened in such a way, the user can put beverages in the accommodating space 41 or take out the beverages stored in the accommodating space 41.

Furthermore, the stepped portions 39*a* and the protrusion 48 are formed in such a manner that they do not interfere with each other. Therefore, the protrusion 48 does not interfere with the stepped portion 39*a* while the home-bar door 43 is pivoted.

The home-bar door 43 is rotated counterclockwise by about 90 degrees such that the accommodating space 41 can be completely opened. In such a state, since both sides of the lower end of the door liner 45 are supported by the stopper 39*s*, the home-bar door cannot be further rotated at an angle greater than a predetermined angle.

As described above, in the home-bar door stopping structure for a refrigerator according to the present invention, the stopper can be applied regardless of the size and shape of the home-bar door. Therefore, although the thickness of the home-bar door is relatively increased due to the installation of an additional device onto the front surface of the home-bar door, the stopper does not hinder the pivotal rotation of the home-bar door until the home-bar is pivoted up to the predetermined angle.

It is apparent to those skilled in the art that various modifications and changes can be made to the present invention within the fundamental technical spirit and scope of the present invention. Therefore, the true scope and spirit of the present invention should be defined by the appended claims.

What is claimed is:

1. A home-bar door stopping structure for a refrigerator, comprising:

an accommodating space provided behind a refrigerator door and communicating with the outside of the refrigerator through an opening formed on a portion of the refrigerator door; and a home-bar door installed at the opening for selectively opening and closing the accommodating space and configured to be pivoted vertically about a lower end of the opening, the home-bar door comprising a rear surface facing the accommodating space, a protrusion portion protruding from the rear surface, and a seating space, the protrusion portion having a thickness at least equal to that of the seating space, wherein the accommodating space defines a stepped portion that is inward of a front surface of the portion of the refrigerator door and that extends vertically along a side of the opening from a top end of the opening to a position above the lower end of the opening such that the stepped portion defines a lower surface positioned to engage the rear surface of the home-bar door to limit a pivot range of the home-bar door when the accommodating space is opened.

2. The home-bar door stopping structure as claimed in claim 1, wherein the seating space is provided on a front surface of the home-bar door for installing an additional device therein, and the thickness of the protrusion portion is greater than that of the seating space.

3. The home-bar door stopping structure as claimed in claim 2, wherein each side end of the protrusion portion is offset from the corresponding side end of the home-bar door by at least a width of a front surface of the stepped portion.

4. The home-bar door stopping structure as claimed in claim 1, wherein at least one side of the protrusion portion is tapered so as not to interfere with vertical pivoting of the home-bar door about the lower end of the opening.

5. The home-bar door stopping structure as claimed in claim 1, wherein the lower surface of the stepped portion defines a plane perpendicular to the side of the opening along which the stepped portion vertically extends.

6. The home-bar door stopping structure as claimed in claim 1, wherein the lower surface of the stepped portion is positioned above the lower end of the opening such that the distance between the lower surface of the stepped portion and the lower end of the opening is greater than the distance from the rear surface of the home-bar door to a front surface of the home-bar door.

7. A refrigerator, comprising:

a refrigerator door; and a home-bar that is provided on the refrigerator door and that includes a home-bar door stopping structure, wherein the home-bar door stopping structure comprises:

an accommodating space provided behind a refrigerator door and communicating with the outside of the refrigerator through an opening formed on a portion of the refrigerator door; and a home-bar door installed at the opening for selectively opening and closing the accommodating space and configured to be pivoted vertically about a lower end of the opening, the home-bar door comprising a rear surface facing the accommodating space, a protrusion portion protruding from the rear surface, and a seating space, the protrusion portion having a thickness at least equal to that of the seating space, wherein the accommodating space defines a stepped portion that is inward of a front surface of the portion of the refrigerator door and that extends vertically along a side of the opening from a top end of the opening to a position above the lower end of the opening such that the stepped portion defines a lower surface positioned to engage the rear surface of the home-bar door to limit a pivot range of the home-bar door when the accommodating space is opened.

8. The refrigerator as claimed in claim 7, wherein the seating space is provided on a front surface of the home-bar door for installing an additional device therein, and the thickness of the protrusion portion is greater than that of the seating space.

9. The refrigerator as claimed in claim 8, wherein each side end of the protrusion portion is offset from the corresponding side end of the home-bar door by at least a width of a front surface of the stepped portion.

10. The refrigerator as claimed in claim 7, wherein at least one side of the protrusion portion is tapered so as not to interfere with vertical pivoting of the home-bar door about the lower end of the opening.

11. The refrigerator as claimed in claim 7, wherein the lower surface of the stepped portion defines a plane perpendicular to the side of the opening along which the stepped portion vertically extends.

12. The refrigerator as claimed in claim 7, wherein the lower surface of the stepped portion is positioned above the lower end of the opening such that the distance between the lower surface of the stepped portion and the lower end of the opening is greater than the distance from the rear surface of the home-bar door to a front surface of the home-bar door.

* * * * *